US006112563A

United States Patent [19]

Ramos

[11] Patent Number: 6,112,563

[45] Date of Patent: Sep. 5, 2000

[54] REMOTE CONTROL LOCKING DEVICE

[76] Inventor: Israel Ramos, 2309 NW. 7 St., Miami, Fla. 33125

[21] Appl. No.: 09/165,493

[22] Filed: Oct. 2, 1998

[51] Int. Cl.[7] ..... E05B 49/00

[52] U.S. Cl. ..... 70/278.1; 70/282; 70/278.7; 292/172; 292/144

[58] Field of Search ..... 70/280, 281, 282, 70/278.1, 278.7; 292/163, 172, 142, 167, 139, 199, 144, 201

[56] References Cited

U.S. PATENT DOCUMENTS

| | | | |
|---|---|---|---|
| 2,716,567 | 8/1955 | Turcott | 292/144 |
| 3,340,710 | 9/1967 | O'brien | 70/282 |
| 3,622,991 | 11/1971 | Lehrer | 340/147 R |
| 4,384,465 | 5/1983 | Muus | 70/129 |
| 4,909,053 | 3/1990 | Zipf, III et al. | 70/283 |
| 5,083,448 | 1/1992 | Karkkainen et al. | 70/277 |
| 5,153,561 | 10/1992 | Johnson | 340/571 |
| 5,531,086 | 7/1996 | Bryant | 70/279 |
| 5,791,179 | 8/1998 | Brask | 70/278 |
| 5,857,365 | 1/1999 | Armstrong | 70/279 |
| 5,862,692 | 1/1999 | Legault et al. | 70/278 |

*Primary Examiner*—B. Dayoan
*Assistant Examiner*—John B. Walsh
*Attorney, Agent, or Firm*—J. Sanchelima

[57] ABSTRACT

A remotely activated locking device for closure elements that is self-contained within the closure elements, electrically operated and reliable. An electric motor with a worm gear is meshed with a gear mechanism to control the movement of a locking tongue member. A gear member is caused to move between two angular positions. The gear member includes a perpendicularly mounted off-center pin. A pivotally mounted elongated arm is pushed by the offset pin to cause the retraction of a spring loaded tongue member. A receiver is also housed within the closure element to activate the motor. A remote transmitter sends a signal to activate the receiver that in turn creates an output for a predetermined amount of time when the code transmitted matches the code stored.

6 Claims, 4 Drawing Sheets

REMOTE CONTROL LOCKING DEVICE

BACKGROUND OF THE INVENTION

1. Field of the Invention

The present invention relates to a locking device for closures, and more particularly, to such devices that are reliable and can be actuated remotely.

2. Description of the Related Art

Many designs for electrically actuated locking devices exist today for closures elements such as doors and windows. The power consumption of these devices is typically supplied by the power network. Thus, the desirability of a self-contained battery operated device. Many of them involve the use of an electromagnet to temporarily hold the locking device in unlock mode. It has been found that the force exerted by an electromagnet can be overcome with relatively small force. Thus, the advantage of mechanical locks that are more volumetric efficient. In the present invention, a gear mechanism activated by an electric motor provides the mechanical advantages of a reliable lock while permitting its remote operation. Also, the power requirements of electromagnets make the use of batteries impractical. The desirability of having a self-contained, hazard-free remotely actuated device is apparent. The present invention provides a solution with a reliable, self-contained and long lasting battery operated device. Even if the present invention is used with a source of electricity connected to the public network, its self-contained battery backup makes it desirable over other devices where the battery would be used up rapidly.

SUMMARY OF THE INVENTION

It is one of the main objects of the present invention to provide a remotely actuated locking device for closure elements that are hingedly mounted to a building aperture.

It is another object of this invention to provide such a locking device with low power consumption of its operation so that use of conventional batteries is practical thereby making it self-contained.

It is still another object of the present invention to provide a locking device that is reliable.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 6 illustrates a block diagram of the electric circuit for the power source of this invention.

DETAILED DESCRIPTION OF THE PREFERRED EMBODIMENT

Figure 1:
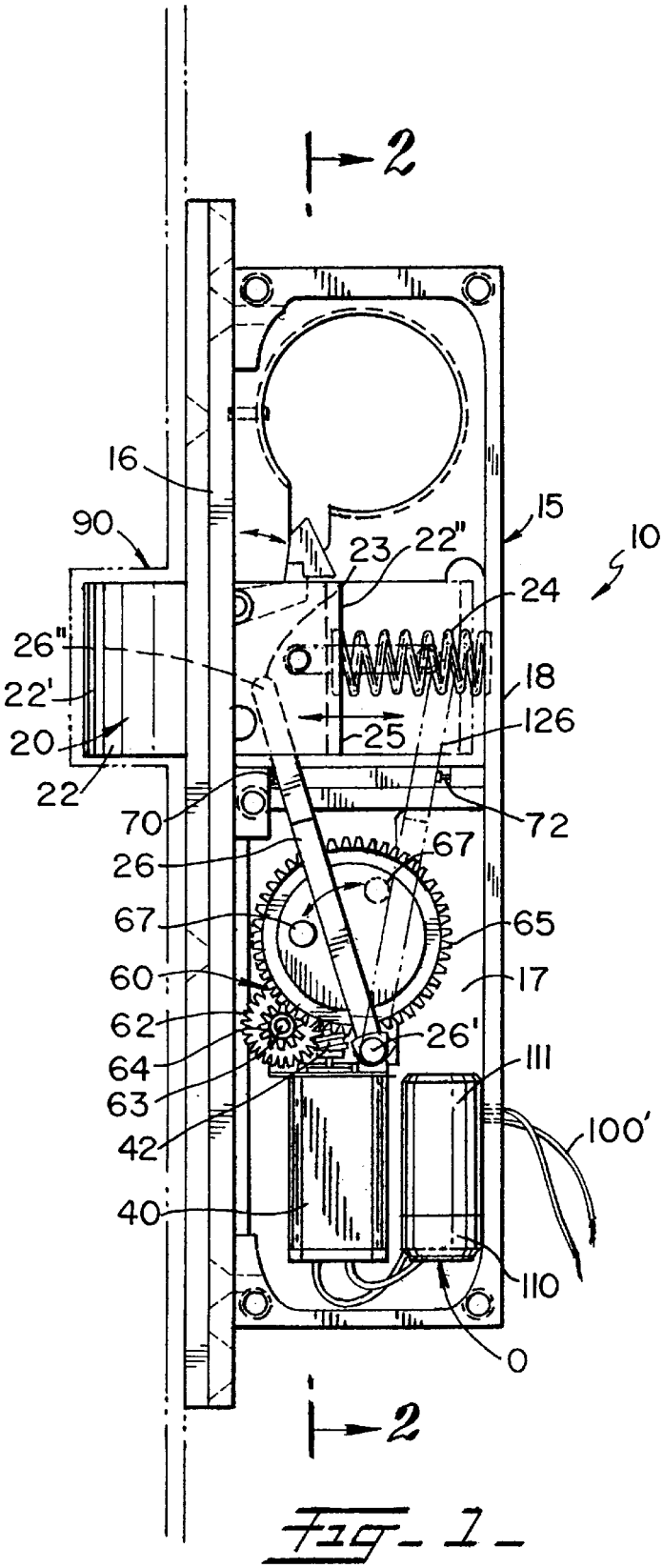
FIG. 1 is a side elevational view of the present invention, showing the angular displacement of the elongated arm and the tongue member in phantom.

Referring now to the drawings, where the present invention is generally referred to with numeral 10, it can be observed that it basically includes housing 15 containing locking tongue mechanism 20 that is actuated by actuating elongated arm 26 of gear mechanism 60 that in turn is actuated by electric motor 40. D.C. (direct current) source (such a battery) 111 powers electric motor 40 and receiver 110. Housing 15 is mounted inside closure elements, such as, hingedly mounted doors and windows.

Locking tongue mechanism 20, as illustrated in FIG. 1, includes locking tongue member 22 biased by spring 24 outwardly and protruding through plate 16. Locking tongue member 22 has locking outer end 22' and inner end 22". Cavity 23 in member 22 is designed to receive free end 26" of actuating elongated arm 26. Free end 26" travels along slot 27 when elongated arm 26 is actuated. Locking tongue mechanism 20 also includes actuating elongated arm 26 that pivots about point 26'. In FIG. 1, arm 26 is shown in phantom with numeral 126, and it represents the open position.

Figure 7:
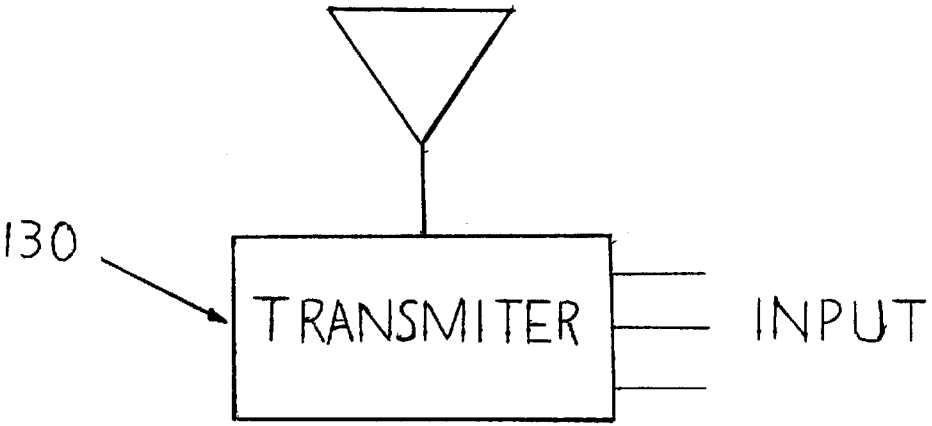
FIG. 7 illustrates a block diagram of the transmiter.

Basically, as seen in FIG. 7, electric motor 40 is activated, inter alia, when receiver 110 receives a coded signal from transmitter 130. Transmitter 130 is activated when a predetermined input or combination of inputs is applied. Other input devices that can be used include programmable keypads, such as those marketed by International Electronic, Inc., 427 Turnpike Street, Canton, Mass. 02021 under the brands Door Guard and Multipad. Receiver 110 includes an output O that activates electric motor 40 that in turn actuates elongated worm gear 42.

Figure 2:
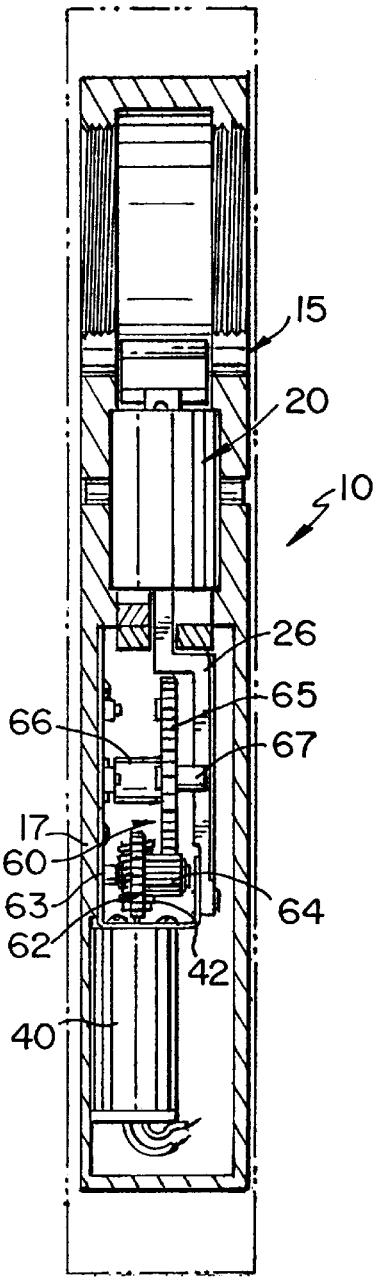
FIG. 2 is a side cross sectional view of the locking mechanism.
Figure 4:
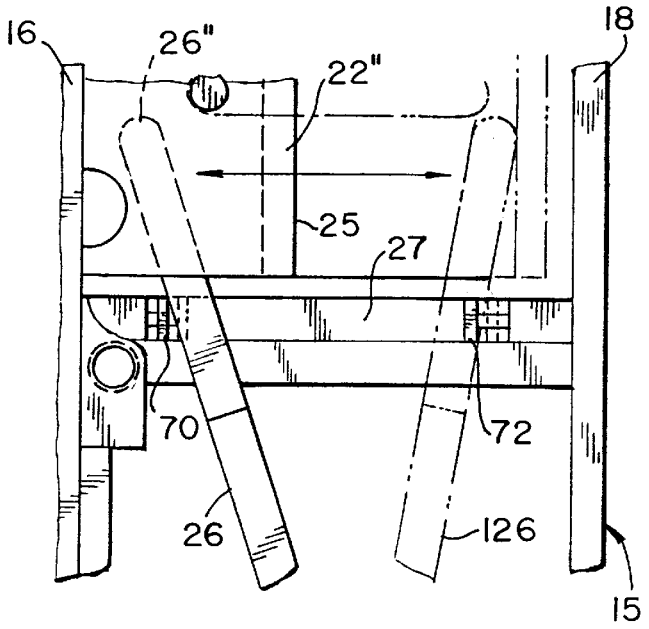
FIG. 4 is an enlarged partial view of the free end of elongated actuated arm and its angular displacement between its locking and unlocking position.

As shown in FIGS. 1 and 2, elongated worm gear 42 is meshed with gear 62 of gear mechanism 60. Driving gear 64 is rigidly mounted to gear 62 and is meshed with driven gear 65. Gear 62, in the preferred embodiment, is rotary mounted to shaft 63 that in turn is mounted to bottom wall 17 of housing 15. Driving gear 64 is cooperately meshed with driven gear 65. Driving gear 64 is sufficiently smaller that driven gear 65 to cause the latter to move between two predetermined angular positions to cause a predetermined angular displacement of actuating elongated arm 26, as best seen in FIGS. 1 and 4. Driven gear 65 is rotary mounted to shaft 66 that in turn is mounted to bottom wall 17 of housing 15. Driven gear 65, in the preferred embodiment, includes perpendicularly mounted pin or actuating member 67. Pin 67 is located at an offset position with respect to shaft 66. Once motor 40 is activated, as described above, driven gear 65 with pin 67 rotate. Pin 67 pushes on elongated arm 26 to pivot about point 26' until free end 26" brings outer end 22' sufficiently outwards plate 16 to clear door latch 90. This causes spring 24 to be compressed between lateral wall 18 of housing 15 and wall 25 of tongue inner portion 22", as best seen in FIG. 1 and 4. In this manner, outer portion 22' of locking tongue member 22 is released from door latch 90. When elongated actuating arm 26 and locking tongue member 22 reach the unlocked position, spring 24 is kept compressed until a locking signal is received.

Then, motor 40 rotates in the opposite direction to cause gear mechanism 60 to also rotate the opposite direction. Once the locking tongue is in the locked position it cannot be moved unless an extraordinary amount of force is applied. Driven gear 65 with pin 67 return to the locked position, thereby bringing free end 26" toward micro-switch 70, as best seen in FIG. 4.

Cables 100' are connected to an outside electrical source (D.C. in the preferred embodiment) that in turn is connected to the public network. Battery 100 may serve as a backup battery to rectifier circuit 120. If device 10 is not used constantly, battery 111 may be all is required.

The output O of receiver 110 stays on until a micro-switch 70 can be used to turn it off limiting the operation of motor 40 after gear 65 reaches a predetermined position and actuates micro-switch 72. Alternatively, an electronic timer can be used to keep motor 40 energized for a determined amount of time. Driving gear 64 is rigidly mounted to gear 62 and is meshed with driven gear 65.

Figure 3:
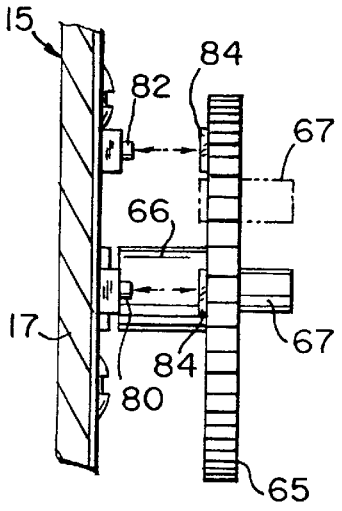
FIG. 3 is an enlarged partial view of the driven gear and photo sensors.

FIG. 3 shows an alternate embodiment wherein photo-sensors 80 and 82 are used to limit the rotation of gear 65 and the operation of motor 40 thus saving electricity. Photo-sensors 80 and 82 are mounted to the inner surface of wall 17 and below driven gear 65. When mirror member 84 reflects the light coming from photo-sensor 80, elongated arm 26 remains in locked position with tongue member 22 housed inside door latch 90. Once driven gear 65 rotates and mirror member 84 reaches and reflects the light coming from photo sensor 82, elongated arm 26 stops its angular displacement and gear 65 stops rotating.

In FIG. 6, the electrical diagram for one of the preferred embodiments for receiver 110 is shown. Basically, a code signal is detected by antenna 150, amplified by radio frequency amplifier and demodulator 112 and the demodulated signal compared with comparator circuit 114 to a pre-programmed code storage circuit 113. If the code in the signal matches, then a timer is activated keeping an output P on for a predetermined adjustable amount of time, preferably between 1 second and 30 seconds. This is the normal amount of time that an individual needs to push open a door or other protected closure. Output P is connected to one of the inputs of NOR gate 116 and through an inverter 118 to NOR gate 117 so that when the input of gate 116 has a logic level, the input of gate 117 has the opposite logic level. The resulting outputs from gates 116 and 117 correspond to the CLOSE and OPEN outputs connected to motor driver 119 that in turn provides the necessary current to drive motor 40. To further ensure that driver 119 stays on only the necessary amount of time (to save energy), micro-switches 70 and 72 can be used. When timer circuit 115 is activated and output P is HIGH, the output of gate 116 will be LOW. In contrast, the open input of driver 119 will receive a HIGH that will cause motor 40 to turn and open locking tongue mechanism 20 and activate buzzer 121 alerting a user that the lock is being released. Once actuating elongated arm 26 reaches the end of its travel, micro-switch 72 is closed resetting timer circuit 115 and causing output P to be LOW. Since micro-switch 70 is LOW when closed, then the output of gate 116 is a HIGH causing the CLOSE output to drive motor 40 in the opposite direction. Once member 26 reaches the opposite end, micro-switch is open and the output of gate 116 is LOW discontinuing the CLOSE output. Photo-sensors 29, 29', and 29" can be used to accomplish a similar function and replacing micro-switches 70 and 72. The objective being in using the least amount of energy opening and closing locking tongue mechanism 20.

Figure 5:
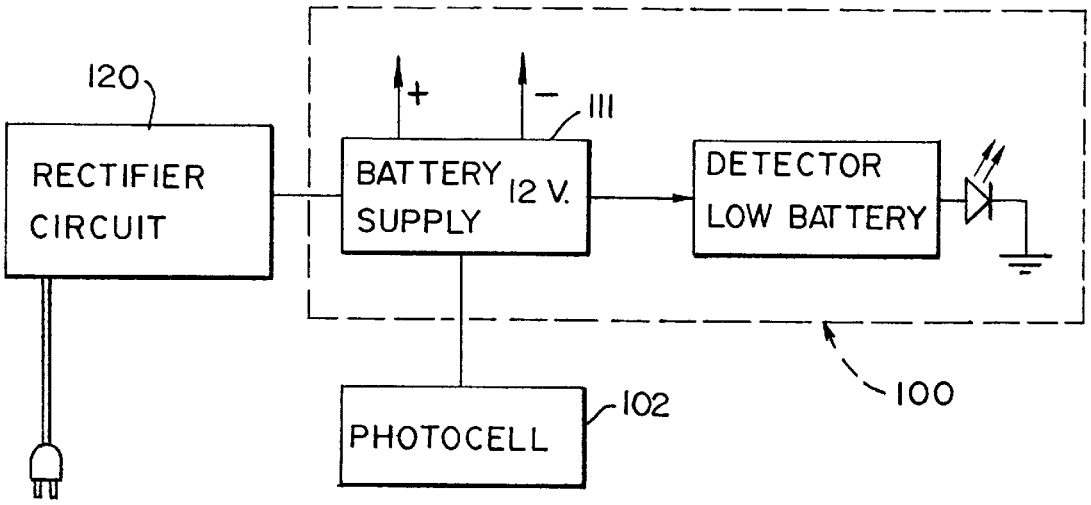
FIG. 5 illustrate a block diagram for the rectifier circuit and photocell for recharging a back up battery.
Figure 5:
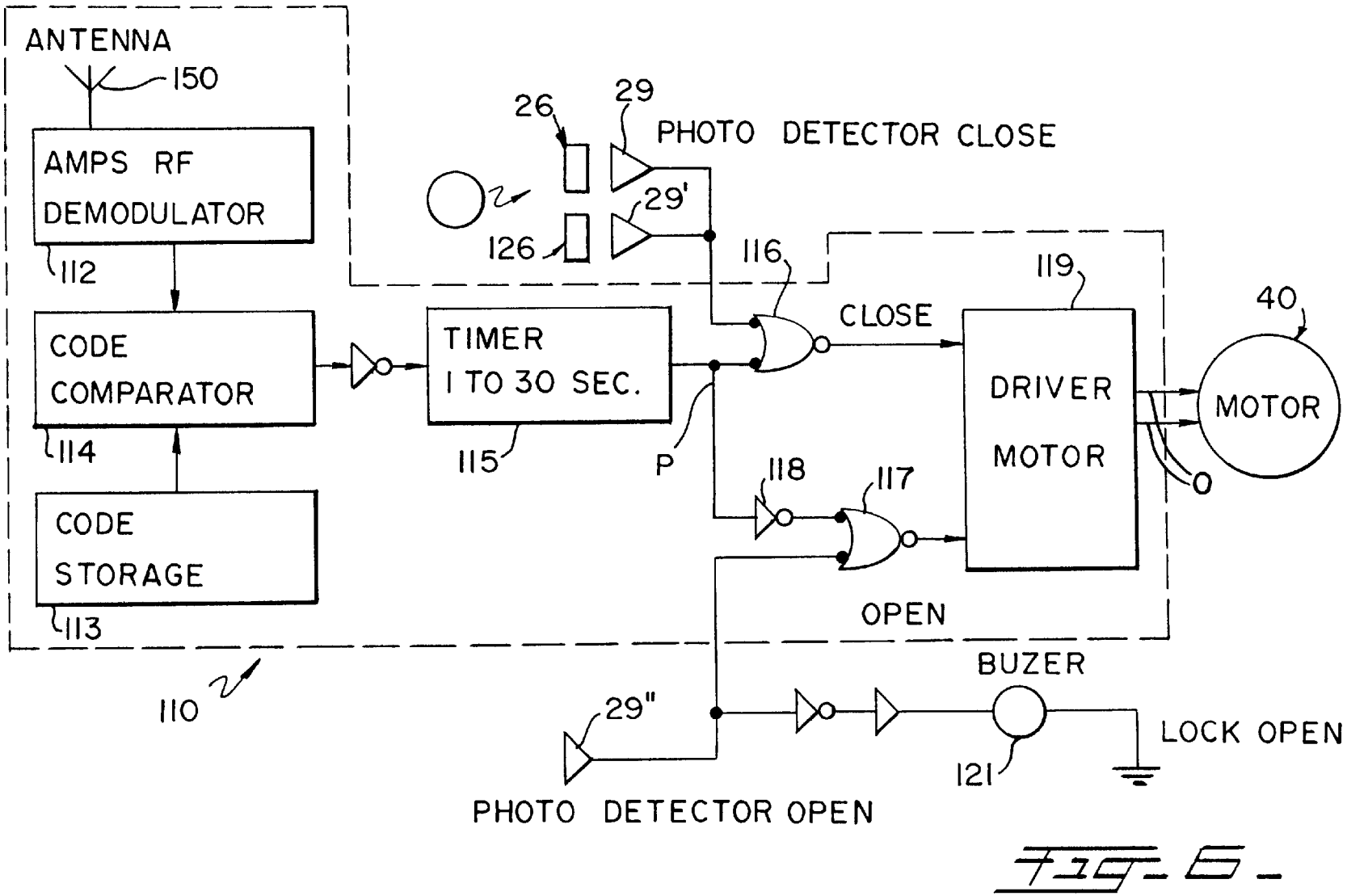

The present invention can be powered by an electrical power source connected to the public network through electrical cables 100', as seen in FIG. 1. A block diagram is shown in FIG. 5 representing one possible implementation of the electrical power circuit used in one of the embodiments. Battery 111 is kept charged by D.C. source, such as rectifier circuit 120, in the preferred embodiment. If the public network power fails, battery 111 takes over. Also, a photocell charger 102 is used to maintain the charge in battery 111 in the event electrical power is lost for a long period of time as shown in FIG. 5. Also, it is possible to not use electricity from a public network and rely exclusively on battery 111 and photocell 102.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A locking device for closure elements that are hingedly mounted to a building aperture with a door latch, and comprising:

A) a housing adapted to be mounted within a closure element;

B) a spring loaded locking tongue member retractable within said closure element from a distended position protruding outwardly from said closure element into a door latch;

C) gear means for moving said locking tongue member between said retractable and distended positions including an elongated arm member having first and second ends, said first end being pivotally mounted to a cooperative point within said housing and said second end being displaced between two angular positions by said gear means, and said second end being cooperatively engaged to said locking tongue member wherein said gear means includes a gear member having an off-center pin perpendicularly mounted thereon so that said off-center pin causes the angular movement of said elongated arm member;

D) worm gear means in meshed engagement with said gear means so that movement of said gear means can only be caused by moving said worm gear means;

E) electrical motor means for rotating said worm gear means;

F) means for actuating said electrical motor means;

G) electrical means for powering said electrical motor means, and said means for actuating said electrical motor means; and H) receiver means housed within said housing for activating said electrical means for powering said electrical motor means; and I) transmitter means for activating said receiver means and being remotely disposed with respect to said receiver means.

2. The locking device set forth in claim 1 wherein further including switch means for limiting the angular displacement of said elongated arm member by causing the electrical power connection to said electrical motor means to be interrupted when said elongated arm member reaches a predetermined position.

3. The locking device set forth in claim 2 wherein said electrical means is housed within said housing.

4. The locking device in claim 3 further including a photocell circuit for recharging said electrical means.

5. The locking device set forth in claim 4 wherein said electrical means includes a rectifier circuit connected to an electrical source of A.C.

6. The device set forth in claim 5 further including:

J) programmable keypad means connected to said means for actuating said electrical motor means.

* * * * *